US008302688B2

(12) United States Patent
Burleson et al.

(10) Patent No.: US 8,302,688 B2
(45) Date of Patent: Nov. 6, 2012

(54) METHOD OF OPTIMIZING WELLBORE PERFORATIONS USING UNDERBALANCE PULSATIONS

(75) Inventors: John D. Burleson, Denton, TX (US); John H. Hales, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 297 days.

(21) Appl. No.: 12/690,433

(22) Filed: Jan. 20, 2010

(65) Prior Publication Data

US 2011/0174487 A1 Jul. 21, 2011

(51) Int. Cl.
*E21B 43/26* (2006.01)
*E21B 43/263* (2006.01)
*E21B 43/18* (2006.01)

(52) U.S. Cl. ..... 166/259; 166/370; 166/63

(58) Field of Classification Search ..... 166/259, 166/271, 370, 63; 175/259, 271, 370, 63
See application file for complete search history.

(56) References Cited

U.S. PATENT DOCUMENTS 3,186,485 A 6/1965 Owen
3,948,321 A 4/1976 Owen et al.
4,175,042 A 11/1979 Mondshine
4,484,632 A 11/1984 Vann
4,557,331 A 12/1985 Stout
4,605,074 A 8/1986 Barfield
4,616,701 A 10/1986 Stout et al.
4,650,010 A 3/1987 George et al.
4,658,902 A 4/1987 Wesson et al.
4,862,964 A 9/1989 George et al.
5,058,674 A 10/1991 Schultz et al.
5,088,557 A 2/1992 Ricles et al.
5,103,912 A 4/1992 Flint
5,287,741 A 2/1994 Schultz et al.
5,551,344 A 9/1996 Couet et al.
5,635,636 A 6/1997 Alexander
5,865,254 A 2/1999 Huber et al.
6,173,783 B1 1/2001 Abbott-Brown et al.
6,325,146 B1 12/2001 Ringgenberg et al.
6,347,673 B1 2/2002 Dailey
6,394,184 B2 5/2002 Tolman et al.
6,446,719 B2 9/2002 Ringgenberg et al.
6,446,720 B1 9/2002 Ringgenberg et al.
6,527,050 B1 3/2003 Sask
6,527,052 B2 3/2003 Ringgenberg et al.
6,554,081 B1 4/2003 Brooks et al.
6,598,682 B2 7/2003 Johnson et al.

(Continued)

OTHER PUBLICATIONS

Stutz et al.; "Dynamic Under Balanced Perforating Eliminates Near Wellbore Acid Stimulation in Low-Pressure Weber Formation"; SPE International Symposium and Exhibition on Formation Damage Control; SPE 86543; Feb. 18-20, 2004; pp. 1-7.

(Continued)

*Primary Examiner* — Cathleen Hutchins
(74) *Attorney, Agent, or Firm* — Lawrence R. Youst

(57) ABSTRACT

A perforating system and method for use in a wellbore. In operation, the perforating system is disposed in the wellbore and used to form perforations in the wellbore. Thereafter, the perforating system is used to perform a sequence of underbalance pulsations in the wellbore, wherein a first underbalance pulsation has a first underbalance signature and a second underbalance pulsation has a second underbalance signature that is different from the first underbalance signature such that perforating tunnel clean up can be optimized based upon wellbore conditions and without causing damage to the perforating tunnels.

19 Claims, 3 Drawing Sheets

U.S. PATENT DOCUMENTS

| | | | | |
|---|---|---|---|---|
| 6,722,438 | B2 | 4/2004 | Sask | |
| 6,732,798 | B2 | 5/2004 | Johnson et al. | |
| 6,874,579 | B2 | 4/2005 | Johnson et al. | |
| 6,896,059 | B2 | 5/2005 | Brooks et al. | |
| 6,959,762 | B2 | 11/2005 | Sask | |
| 6,966,377 | B2 | 11/2005 | Johnson et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,285,812 | B2 | 10/2007 | Tang et al. | |
| 7,287,589 | B2 | 10/2007 | Grove et al. | |
| 7,428,921 | B2 | 9/2008 | Grove et al. | |
| 7,571,768 | B2 | 8/2009 | Cuthill | |
| 7,861,784 | B2 | 1/2011 | Burleson et al. | |
| 2004/0231840 | A1* | 11/2004 | Ratanasirigulchai et al. | 166/259 |
| 2007/0034369 | A1 | 2/2007 | Dang | |
| 2008/0105430 | A1* | 5/2008 | Cuthill | 166/297 |

OTHER PUBLICATIONS

Schatz et al.; High-Speed Pressure and Accelerometer Measurements Characterize Dynamic Behavior During Perforating Events in Deepwater Gulf of Mexico; SPE Annual Technical Conference and Exhibition; SPE 90042; Sep. 26-29, 2004; pp. 1-15.

Halleck; "Recent Advances in Understanding Perforator Penetration and Flow Performance"; SPE Drilling & Completion; Mar. 1997; pp. 19-26.

Halleck et al.; "The Basis and Use of the API RP43 Flow Test for Shaped-Charge Oil Well Perforators"; JCPT, vol. 36, No. 5; May 1997; pp. 53-61.

Behrmann et al.; "Borehole Dynamics During Underbalanced Perforating"; SPE European Formation Damage Conference; SPE 38139; Jun. 2-3, 1997; pp. 17-24.

Swift et al.; "Micro-Mechanical Modeling of Perforating Shock Damage"; SPE Formation Damage Conference; SPE 39458; Feb. 18-19, 1998; pp. 381-391.

Marple et al.; "Successful Completions in the Gulf of Mexico Using the Single-Trip Perforation and Packing System"; Offshore Technology Conference; OTC 8583; May 4-7, 1998; pp. 83-93.

Halleck et al.; "Mechanical Damage Caused by Perforations May Affect Fracture Breakdown"; SPE Eastern Regional Meeting; SPE 51051; Nov. 9-11, 1998; pp. 131-137.

Thiercelin et al.; "Cement Design Based on Cement Mechanical Response"; SPE Drilling & Completion; Dec. 1998; pp. 266-273.

Dyson et al.; "Best Completion Practices"; SPE/IADC Drilling Conference; SPE/IADC 52810; Mar. 9-11, 1999; pp. 1-7.

Behrmann et al.; "Underbalance or Extreme Overbalance"; SPE Prod. & Facilities, vol. 14, No. 3; Aug. 1999; pp. 187-196.

"Comparision of Balanced and Underbalanced Perforating"; JPT; Oct. 1999; pp. 64-66.

"Optimum Completion Design"; Vann Systems; 19 pages, Jul. 1988.

"Optiumum Completion Design"; TCP Virtual Field Guide; 263 pages (Undated but admitted prior art).

Baker et al.; "The New Dynamics of Underbalanced Perforating"; Oilfield Review; Winter 2003/2004; pp. 54-67.

"PURE High-Speed Pressure Gauge"; Schlumberger; Apr. 2007.

"PURE Dynamic Underbalance Technique for Increased Productivity"; Schlumberger; Aug. 2003.

"Surge Pro Service"; Halliburton; Perforating Solutions (Undated but admitted prior art).

Slentz; "Geochemistry of Reservoir Fluids as a Unique Approach to Optimum Reservoir Management"; Middle East Oil Technical Conference of the Society of Petroleum Engineers; SPE 9582; Mar. 9-12, 1981; 14 pages.

Ruhovets et al.; "Volumes, Types, and Distribution of Clay Minerals in Reservoir Rocks Based on Well Logs"; SPE/DOE Unconventional Gas Recovery Symposium of the Society of Petroleum Engineers; SPE/DOE 10796; May 16-18, 1982; 14 pages.

Bartuslak et al.; "Experiments Investigate Underbalance Flow Velocity and Volume Needed to Obtain Perforation Cleanup"; Eastern Regional Conference and Exhibition; SPE 26896; Nov. 3-4, 1983; pp. 1-10.

Regalguto et al.; "Underbalanced Perforation Characteristics as Affected by Differential Pressure"; 18th Annual OTC; OTC 5245; May 5-8, 1986; 8 pages.

King et al.; "A Field Study of Underbalance Pressures Necessary to Obtain Clean Perforations Using Tubing-Conveyed Perforating"; Journal of Petroleum Technology; SPE 14321; Jun. 1986; pp. 662-664.

Regalbuto et al.; "Underbalanced Perforation Characteristics as Affected by Differential Pressure"; SPE Production Engineering; SPE 15816; Feb. 1988; pp. 83-88.

Colle; "Increase Production with Underbalanced Perforation"; Petroleum Engineer International; Jul. 1988; pp. 39-42.

Behrmann et al.; "Effect of Concrete and Berea Strengths on Perforator Performance and Resulting Impact on the New API RP-43"; 63rd Annual Technical Conference and Exhibition of the Society of Petroleum Engineers; SPE 18242; Oct. 2-5, 1988; pp. 1-15.

Behrmann et al.; "Effects of Wellbore Pressure on Perforator Penetration Depth"; 63rd Annual Technical Conference and Exhibition of the Society of Petroleum Engineers; SPE 18243; Oct. 2-5, 1988; pp. 1-7.

Halleck et al.; "Reduction of Jet Perforator Penetration in Rock Under Stress"; 63rd Annual Technical Conference and Exhibition of the Society of Petroleum Engineers; SPE 18245; Oct. 2-5, 1988; pp. 627-641.

Halleck et al.; "Effects of Underbalance on Perforation Flow"; SPE Production Engineering; May 1989; pp. 113-116.

Deo et al.; "Linear and Radial Flow Targets for Characterizing Downhole Flow in Perforations"; SPE Producting Engineering; Aug. 1989; pp. 295-300.

Crawford; "Underbalanced Perforating Design"; 64th Annual Technical Conference and Exhibition of the Socieyt of Petroleum Engineers; SPE 19749; Oct. 8-11, 1989; pp. 431-444.

Pearce et al.; "Clean Out Existing Well Perforations by Surging the Formation"; World Oil; Dec. 1989; 5 pages.

Tariq; "New, Generalized Criteria for Determining the Level of Underbalance for Obtaining Clean Perforations"; 65th Annual Technical Conference and Exibition of the Society of Petroleum Engineers; SPE 20636; Sep. 23-25, 1990; pp. 215-228.

Andersen et al.; "Exploiting Reservoirs with Horizontal Wells: The Maersk Experience"; Offshore; Feb. 1991; pp. 23-32.

Schultz et al.; "Small-Volume Sampling Technique Brings Economy and Efficiency to Well Testing Operations"; Production Operations Symposium; SPE 21706; Apr. 7-9, 1991; pp. 693-700.

Petak et al.; "Surge Test Simulation"; Rocky Mountain Regional Meeting and Low-Permeability Reservoirs Symposium; SPE 21832; Apr. 15-17, 1991; pp. 259-274.

Petak et al.; "Drillstem Test and Closed-Chamber Drillstem Test Simulation"; Offshore Europe Conference; SPE 23115; Sep. 3-6, 1991; pp. 143-160.

Halleck et al.; "Prediction of In-Situ Shaped-Charge Penetration Using Acoustic and Density Logs"; 66th Annual Technical Conference and Exibition of the Society of Petroleum Engineers; SPE 22808; Oct. 6-9, 1991; pp. 483-490.

Schatz et al.; "High-Speed Downhole Memory Recorder and Software Used to Design and Confirm Perforating/ Propellant Behavior and Formation Fracturing"; SPE Annual Technical Conference and Exhibition; SPE 56434; Oct. 3-6, 1999; pp. 1-9.

Dogulu et al.; "Numerical Simulation of Perforation Cleanup with Transient Surge Flow"; Proceedings of ETCE/OMAE2000 Joint Conference; Feb. 14-17, 2000; pp. 1-9.

Arora et al.; "The Nature of the Compacted Zone Around Perforation Tunnels"; SPE International Symposium on Formation Damage Control; SPE 58720; Feb. 23-24, 2000; pp. 1-12.

Venkitaraman et al.; "Perforating Requirements for Sand Prevention"; SPE International Symposium on Formation Damage Control; SPE 58788; Feb. 23-24, 2000; pp. 1-5.

Walton; "Optimum Underbalance for the Removal of Perforation Damage"; SPE Annual Technical Conference and Exhibition; SPE 63108; Oct. 1-4, 2000; pp. 1-13.

Venkitaraman et al.; "Perforating Requirements for Sand Control"; SPE European Petroleum Conference; SPE 65187; Oct. 24-25, 2000; pp. 1-8.

Karacan; "Effect of Pore Fluid Type on Perforation Damage and Flow Characteristics"; SPE Production and Operations Symposium; SPE 67290; Mar. 24-27, 2001; pp. 1-11.
Walton et al.; "Perforating Unconsolidated Sands: An Experimental and Theoretical Investigation"; SPE Annual Technical Conference and Exhibition; SPE 71458; Sep. 30-Oct. 3, 2001; pp. 1-14.
Walton et al.; "Laboratory Experiments Provide New Insights into Underbalanced Perforating"; SPE Annual Technical Conference and Exhibition; SPE 71642; Sep. 30-Oct. 3, 2001; pp. 1-8.
Walton et al.; "Perforating Unconsolidated Sands: An Experimental and Theoretical Investigation"; SPE Drilling & Completion; Sep. 2002; pp. 141-150.
Behrmann et al.; "Measurement of Additional Skin Resulting From Perforation Damage"; 66th Annual Technical Conference and Exibition of the Society of Petroleum Engineers; SPE 22809; Oct. 6-9, 1991; pp. 491-502.
Hsia et al.; "Perforating Skin as a Function of Rock Permeability and Underbalance"; 66th Annual Technical Conference and Exibition of the Society of Petroleum Engineers; SPE 22810; Oct. 6-9, 1991; pp. 503-510.
Pucknell et al.; "An Investigation of the Damaged Zone Created by Perforating"; 66th Annual Technical Conference and Exibition of the Society of Petroleum Engineers; SPE 22811; Oct. 6-9, 1991; pp. 511-522.
Behrmann et al.; "Effects of Underbalance and Effective Stress on Perforation Damage in Weak Sandstone: Initial Results"; 67th Annual Technical Conference and Exibition of the Society of Petroleum Engineers; SPE 24770; Oct. 4-7, 1992; pp. 81-90.
Halleck et al.; "X-Ray CT Observations of Flow Distribution in a Shaped-Charge Perforation"; 67th Annual Technical Conference and Exibition of the Society of Petroleum Engineers; SPE 24771; Oct. 4-7, 1992; pp. 91-100.
Tronvoll et al.; "Observations of Sand Production and Perforation Cleanup in a Weak Sandstone"; SPE/ISRM Rock Mechanics in Petroleum Engineering Conference; SPE 28071; Aug. 29-31, 1994; pp. 355-360.
Halleck et al.; "Estimating Perforation Flow From Variation in Indentation Hardness"; Society of Petroleum Engineers; SPE 24769; 1995; pp. 1-8.
Blosser; "An Assessment of Perforating Performance for High Compressive Strength Non-Homogeneous Sandstones"; European Formation Damage Conference; SPE 30082; May 15-16, 1995; pp. 31-35.
Rezmer-Cooper et al.; "Complex Well Control Events Accurately Represented by an Advanced Kick Simulator"; SPE European Petroleum Conference; SPE 36829; Oct. 22-24, 1995; pp. 141-156.
Scott et al.; "Air Foam Improves Efficiency of Completion and Workover Operations in Low-Pressure Gas Wells"; SPE Drilling & Completion; Dec. 1995; pp. 219-225.
Petitjean et al.; "Modeling of Fracture Propagation During Overbalanced Perforating"; Society of Petrolum Engineers; SPE 28560; 1996; 12 pages.
Couet et al.; "Well-Productivity Improvement by Use of Rapid Overpressured Perforation Extension: Case History"; JPT; Feb. 1996; pp. 154-159.
Bartusiak et al.; "Experimental Investigation of Surge Flow Velocity and vol. Needed to Obtain Perforation Cleanup"; Journal of Petroleum Science and Engineering; Apr. 8, 1996; pp. 19-28.
Behrmann; "Underbalance Criteria for Minimum Perforation Damage"; SPE Drilling & Completion; Sep. 1996; pp. 173-177.
"Halleck et al.;" Experiments and Computer Analysis Show How Perforators Damage Natural Fractures; SPE Eastern Regional Meeting; SPE 37330; Oct. 23-25, 1996; pp. 1-11.
Behrmann et al.; "New Underbalanced Perforating Technique Increases Completion Efficiency and Eliminates Costly Acid Stimulation"; SPE Annual Technical Conference and Exhibition; SPE 77364; Sep. 29-Oct. 2, 2002; pp. 1-15.
Karacan et al.; "Correlating Particle Size Distribution in a Crushed Zone to Perforating Permeability Damage and Modeling Using Fragmentation Fractal Theory"; SPE Annual Technical Conference and Exhibition; SPE 77365; Sep. 29-Oct. 2, 2002; pp. 1-11.
Waskoenig et al.; "A Methoed for Real-Time Well Clean-Up Optimization"; SPE Annual Technical Conference and Exhibition; SPE 77409; Sep. 29-Oct. 2, 2002; pp. 1-7.
Detwiler et al.; "Evaluation of the Relative Importance of Parameters Influencing Perforation Cleanup"; SPE International Symposium and Exhibition on Formation Damage Control; SPE 86538; Feb. 18-20, 2004; pp. 1-7.
Halleck et al.; "Changes in Perforation-Induced Formation Damage with Degree of Underbalance: Comparison of Sandstone and Limestone Formations"; SPE International Symposium and Exhibition; SPE 86541; Feb. 18-20, 2004; pp. 1-7.

* cited by examiner

METHOD OF OPTIMIZING WELLBORE PERFORATIONS USING UNDERBALANCE PULSATIONS

TECHNICAL FIELD OF THE INVENTION

This invention relates, in general, to perforating a cased wellbore that traverses a subterranean formation and, in particular, to the optimization of the perforations using a controlled sequence of underbalance pulsations.

BACKGROUND OF THE INVENTION

Without limiting the scope of the present invention, its background will be described with reference to perforating a subterranean formation using a hollow carrier type perforating gun, as an example.

After drilling the various sections of a wellbore that traverses subterranean formations, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired hydraulic openings.

The perforating operation may be conducted in an overbalanced pressure condition, wherein the pressure in the wellbore proximate the perforating interval is greater than the pressure in the formation or in an underbalanced pressure condition, wherein the pressure in the wellbore proximate the perforating interval is less than the pressure in the formation. When perforating occurs in an underbalanced pressure condition, formation fluids flow into the wellbore shortly after the perforations are created. This inflow is beneficial as perforating generates debris from the perforating guns, the casing and the cement that may otherwise remain in the perforation tunnels and impair the productivity of the formation. As clean perforations are essential to a good perforating job, perforating in an underbalanced condition is preferred in many instances. It has been found, however, that due to safety concerns, it is desirable to maintain an overbalanced pressure condition during most well completion operations. For example, if the perforating guns were to malfunction and prematurely initiate creating communication paths to a formation, the overbalanced pressure condition will help to prevent any uncontrolled fluid flow to the surface.

To overcome the safety concerns but still obtain the benefits associated with underbalanced perforating, efforts have been made to create a dynamic underbalance condition in the wellbore following charge detonation. The dynamic underbalance is a transient pressure condition created in the wellbore during and immediately following the perforating operation that allows the wellbore to be maintained, for example, at an overbalanced pressure condition prior to perforating. The dynamic underbalance condition can be created using specifically designed surge chambers or simply using hollow carrier type perforating guns. When hollow carrier type perforating guns are used, the interior of the perforating guns contains the shaped charges, the detonating cord and the charge holder tubes. The remaining volume inside the perforating guns consists of air at essentially atmospheric pressure. Upon detonation of the shaped charges, the interior pressure rises to tens of thousands of psi within microseconds. The detonation gases then exit the perforating guns through the holes created by the shaped charge jets and rapidly expand to lower pressure as they are expelled from the perforating guns. The interior of the perforating guns becomes a substantially empty chamber which rapidly fills with the surrounding wellbore fluid. Further, as there is a communication path via the perforation tunnels between the wellbore and the reservoir, formation fluids rush from their region of high pressure in the reservoir through the perforation tunnels and into the region of low pressure within the wellbore and the empty perforating guns. All this action takes place within milliseconds of gun detonation.

While creating a dynamic underbalance is beneficial in many circumstances, it has been found that there are some circumstances where excessive dynamic underbalance causes the perforation tunnels to fail due to, for example, sanding. Also, it has been found that there are some circumstances where insufficient dynamic underbalance fails to fully clean the perforation tunnels. A need has therefore arisen for an improved perforating method that is operable to create effective perforation tunnels that enhance fluid communication between the formation and the wellbore. A need has also arisen for such an improved perforating method that is operable to clean the perforation tunnels without causing damage to the perforation tunnels. Further, a need has arisen for such an improved perforating method that is customizable based upon reservoir conditions.

SUMMARY OF THE INVENTION

The present invention disclosed herein comprises an improved method for perforating a cased wellbore that creates effective perforation tunnels that enhance fluid communication between the formation and the wellbore. The method of the present invention is operable to clean the perforation tunnels without causing damage to the perforation tunnels. In addition, the method of the present invention is customizable based upon reservoir conditions.

In one aspect, the present invention is directed to a method for optimizing perforations in a wellbore. The method includes disposing a perforating string in the wellbore, perforating the wellbore and performing a sequence of underbalance pulsations in the wellbore, wherein a first underbalance pulsation has a first underbalance signature and a second underbalance pulsation has a second underbalance signature that is different from the first underbalance signature.

In one embodiment, the second underbalance signature may have a peak underbalance pressure that is greater than the peak underbalance pressure of the first underbalance signature. In another embodiment, the second underbalance signature may have a peak underbalance pressure that is less than the peak underbalance pressure of the first underbalance signature. In one embodiment, the second underbalance signature may have a duration that is greater than the duration of the first underbalance signature. In another embodiment, the second underbalance signature may have a duration that is less than the duration of the first underbalance signature. In certain embodiments, the second underbalance signature may have a peak underbalance pressure that is greater than the peak underbalance pressure of the first underbalance signature and the second underbalance signature may have a duration that is less than the duration of the first underbalance signature. In other embodiments, the second underbalance signature may have a peak underbalance pressure that is less than the peak underbalance pressure of the first underbalance signature and the second underbalance signature may have a duration that is greater than the duration of the first underbalance signature.

The method may also include, performing first, second and third underbalance pulsations, wherein each of the first, second and third underbalance pulsations has a different underbalance signature, wherein the underbalance signatures of the first, second and third underbalance pulsations have progressively smaller peak underbalance pressures, wherein the underbalance signatures of the first, second and third underbalance pulsations have progressively larger durations, wherein the time period between the first and second underbalance pulsations is less than the time period between the second and third underbalance pulsations, wherein the time period between the first and second underbalance pulsations is greater than the time period between the second and third underbalance pulsations, wherein a subsequent underbalance pulsation begins after reaching a substantially balanced condition in the wellbore following a prior underbalance pulsation or wherein a subsequent underbalance pulsation begins before reaching a substantially balanced condition in the wellbore following a prior underbalance pulsation.

In another aspect, the present invention is directed to a method for optimizing perforations in a wellbore. The method includes disposing a perforating string in the wellbore, perforating the wellbore and performing a sequence of underbalance pulsations in the wellbore including a plurality of underbalance pulsations each having a different underbalance signature. In this method, the peak underbalance pressure of each of the underbalance pulsations may become progressive smaller, the duration of each of the underbalance pulsations may become progressive larger or the time period between each of the underbalance pulsations may become progressive larger.

In another aspect, the present invention is directed to a method for optimizing perforations in a wellbore. The method includes disposing a perforating string in the wellbore, perforating the wellbore and performing a sequence of underbalance pulsations in the wellbore including at least three underbalance pulsations, wherein two of the at least three underbalance pulsations have substantially similar underbalance signatures and wherein one of the at least three underbalance pulsations has an underbalance signature that is different from the substantially similar underbalance signatures.

In one sequence, the two underbalance pulsations having substantially similar underbalance signatures may be performed prior to performing the underbalance pulsation having the different underbalance signature. In another sequence, the two underbalance pulsations having substantially similar underbalance signatures may be performed after performing the underbalance pulsation having the different underbalance signature.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
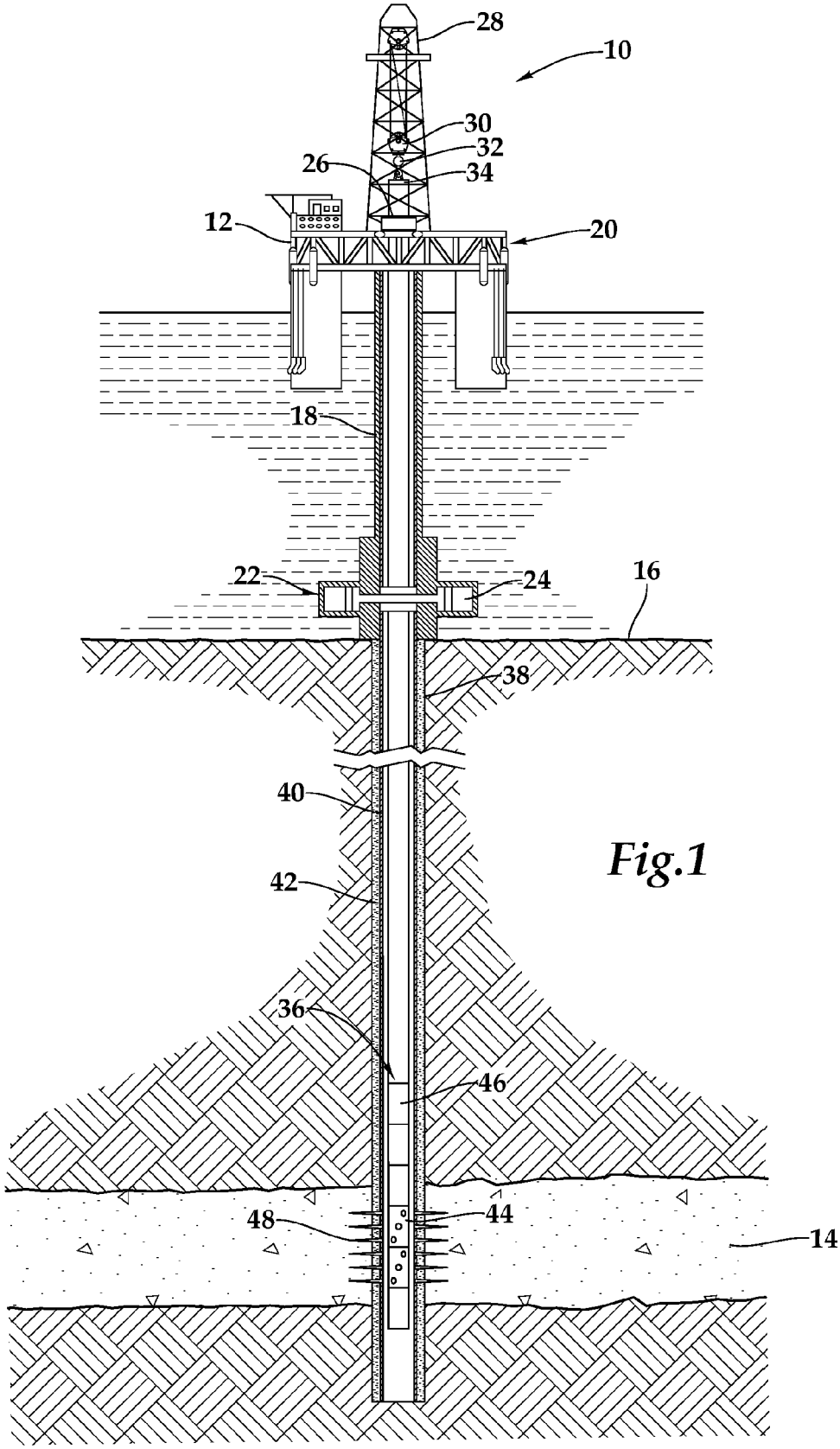
FIG. 1 is a schematic illustration of an offshore oil and gas platform operating a perforating system for optimizing wellbore perforations according to the present invention.

Referring initially to FIG. 1, a perforating system for optimizing wellbore perforations of the present invention is operating from an offshore oil and gas platform that is schematically illustrated and generally designated 10. The perforating system is customizable according to reservoir and other conditions to be operable to create a sequence of underbalance pulsations in the wellbore following the perforating event that enhance fluid communication between the formation and the wellbore. Preferably, the perforating system is designed and operated based upon software modeling of various reservoir and wellbore parameters such that the underbalance pulsations perform the desired cleaning operation in the perforated interval.

As depicted, a semi-submersible platform 12 is centered over a submerged oil and gas formation 14 located below sea floor 16. A subsea conduit 18 extends from deck of platform 12 to wellhead installation 22 including subsea blow-out preventers 24. Platform 12 has a hoisting apparatus 26, a derrick 28, a travel block 30, a hook 32 and a swivel 34 for raising and lowering pipe strings, such as a perforating string 36. A wellbore 38 extends through the various earth strata including formation 14. A casing is cemented within wellbore 38 by cement 42. Perforating string 36 includes various tools such as a plurality of perforating gun assemblies 44 and a plurality of pulsation chambers 46 that are depicted as low pressure or empty chambers and are operable to sequentially draw down the pressure in the near wellbore region after the perforating event.

When it is desired to perform the perforation operation, perforating string 36 is lowered through casing 40 until perforating guns 44 are properly positioned relative to formation 14 and the pressure within wellbore 38 is adjusted to the desire pressure regime, for example, static overbalanced, static underbalanced or static balanced. Thereafter, the shaped charges within perforating guns 44 are fired such that the liners of the shaped charges form jets that create a spaced series of perforations 48 extending outwardly through casing 40, cement 42 and into formation 14, thereby allowing communication between formation 14 and wellbore 38. During the perforating event, numerous conditions can occur that may cause a reduction in the productivity of the well. For example, a skin or similar layer of low permeability sand grains may line perforations 48, debris from the shaped charges or charge carrier may fill perforations 48, or loose rock or other particles may plug perforations 48.

To overcome the damage created during the perforating event, pulsation chambers 46 are used to control and manipulate the pressure in the perforated interval such that perforation skin, tunnel debris and the like may be removed from perforations 48. For example, simultaneously with and after the perforating event, the operation of pulsation chambers 46 may commence to create a series of underbalance pulsations in the near wellbore region. Pulsation chambers 46 are utilized to control the wellbore pressure regime by sequentially decreasing the wellbore pressure to pressures below reservoir pressure for predetermined time durations, to predetermined peak pressures and at predetermined intervals to obtain effective perforation. The operation of pulsation chambers 46 to generating the desired underbalance pulsations may be controllable by a well operator or may be automatically controlled by a surface or downhole controller or timer. Pulsation chambers 46 may be activated by control signals including mechanical signals, electrical signals, optical signals, pressure signals, hydraulic signals or the like. Pulsation chambers 46 may be actuated mechanically, electrically, explosively, in response to pressure or like or a combination thereof.

Even though FIG. 1 depicts a vertical wellbore, it should be understood by those skilled in the art that the systems and methods of the present invention are equally well suited for use in wellbores having other directional orientations including deviated wellbores, horizontal wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, it should be understood by those skilled in the art that the systems and methods of the present invention are equally well suited for use in onshore operations.

In addition, even though a perforating string having two perforating guns and three pulsation chambers in a particular orientation has been depicted, it should be understood by those skilled in the art that any arrangement of perforating guns and pulsation chambers may be utilized in conjunction with the present invention including both more or less perforating guns and/or pulsation chambers as well as different configurations of perforating guns and pulsation chambers wherein some or all of the pulsation chambers could be below the perforating guns or wherein the perforating guns and pulsation chambers could arranged such that some or all of the pulsation chambers are between certain of the perforating guns, without departing from the principles of the present invention. As another alternative, the pulsation chambers could be positioned remote from the perforating guns in the perforating string or in a different tubular string.

Figure 2:
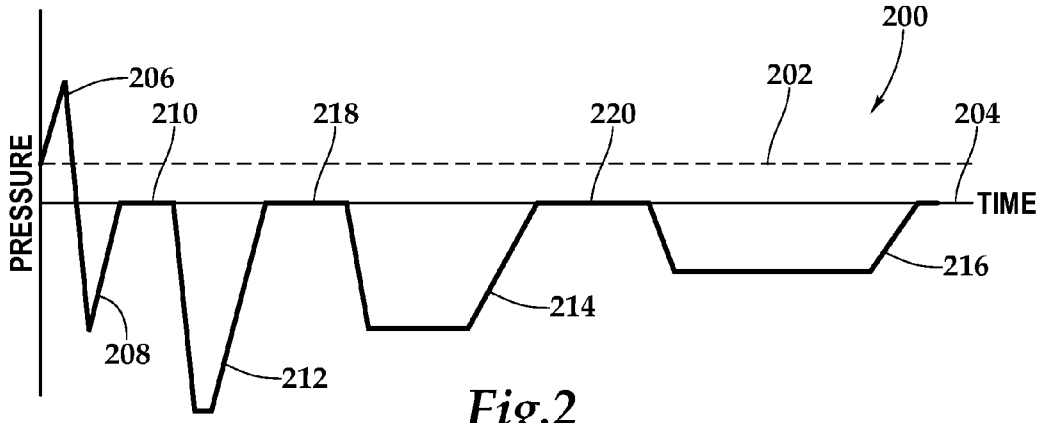
FIG. 2 is a pressure versus time diagram depicting the pressure response in a wellbore created during the performance of a method for optimizing wellbore perforations according to the present invention.

Referring now to FIG. 2, a pressure versus timing graph illustrating pressure changes in a perforating interval is generally designated 200. As illustrated, the wellbore has an initial static overbalance pressure condition depicted as dashed line 202, which is at a predetermined pressure above reservoir pressure, which is indicated at 204. Even though a static overbalance pressure has been depicted, the present invention is equally well-suited for use in wellbores having other pre-perforation pressure conditions such as wellbores having an initial balanced pressure condition or a static underbalance pressure condition.

Upon detonation of the shaped charges within the perforating gun or gun string, an initial dynamic overbalance condition is generated in the near wellbore region due to detonation gases, which is indicated at 206. The empty volume within the perforating guns and any associated blank pipe may then generate a dynamic underbalance condition in the near wellbore region, which is indicated at 208. After a short time, the wellbore pressure stabilizes at reservoir pressure as indicated at 210. Thereafter, a customizable sequence of underbalance pulsations of the present invention may be performed to create effective perforation tunnels that enhance fluid communication between the formation and the wellbore. In the illustrated sequence, a first underbalance pulsation is indicated at 212, a second underbalance pulsation is indicated at 214 and a third underbalance pulsation is indicated at 216. Each of the underbalance pulsations 212, 214, 216 has a specific underbalance signature that is created based upon factors such as the volume, location and flow rate into the pulsation chamber used to generate a specific underbalance pulsation.

As illustrated, underbalance pulsation 212 has a peak underbalance pressure that is greater than the peak underbalance pressures of underbalance pulsations 214, 216 and underbalance pulsation 214 has a peak underbalance pressure that is greater than the peak underbalance pressure of underbalance pulsation 216. Likewise, underbalance pulsation 212 has a duration that is less than the durations of underbalance pulsations 214, 216 and underbalance pulsation 214 has duration that is less than the duration of underbalance pulsation 216. The particular signature of each underbalance pulsation and the signature sequence of the underbalance pulsations are customizable based upon various reservoir factors such as the strength of the formation, the permeability of the formation and the like. The signature of an underbalance pulsation can be designed based upon factors such as the volume of the pulsation chamber used to create the underbalance pulsation, the size and number of fluid ports or openings in the pulsation chamber and the location of the pulsation chamber relative to the perforating interval.

The time period between each underbalance pulsation is also customizable and may be on the order of milliseconds to second. For example, as illustrated, the time period between underbalance pulsation 212 and underbalance pulsation 214 is less than the time period between underbalance pulsation 214 and underbalance pulsation 216. Also, as illustrated, underbalance pulsation 214 does not begin until after underbalance pulsation 212 is complete and the wellbore pressure has substantially stabilized at reservoir pressure indicated at 218. Likewise, underbalance pulsation 216 does not begin until after underbalance pulsation 214 is complete and the wellbore pressure has substantially stabilized at reservoir pressure indicated at 220.

Figure 3:
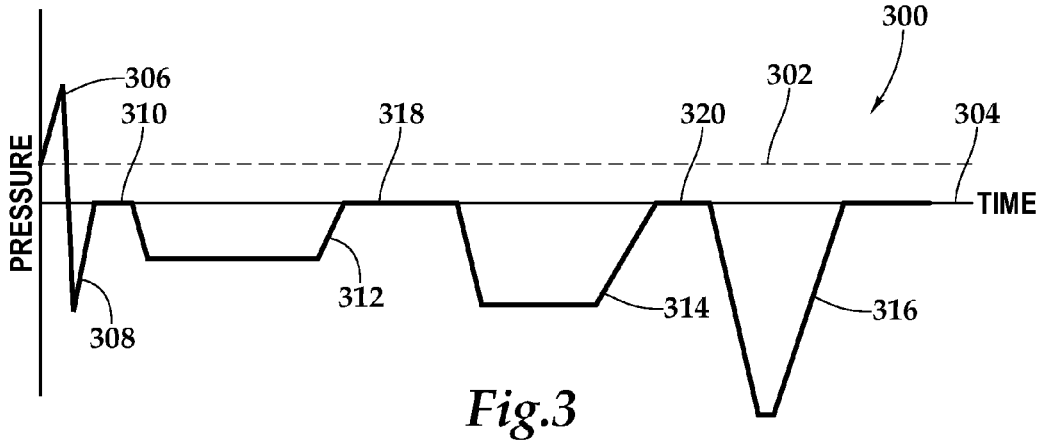
FIG. 3 is a pressure versus time diagram depicting the pressure response in a wellbore created during the performance of a method for optimizing wellbore perforations according to the present invention.

Referring next to FIG. 3, a pressure versus timing graph illustrating pressure changes in a perforating interval is generally designated 300. As illustrated, the wellbore has an initial static overbalance pressure condition depicted as dashed line 302, which is at a predetermined pressure above reservoir pressure, which is indicated at 304. Upon detonation of the shaped charges within the perforating gun or gun string, an initial dynamic overbalance condition is generated in the near wellbore region due to detonation gases, which is indicated at 306. The empty volume within the perforating guns and any associated blank pipe may then generate a dynamic underbalance condition in the near wellbore region, which is indicated at 308. After a short time, the wellbore pressure stabilizes at reservoir pressure as indicated at 310.

Thereafter, a customizable sequence of underbalance pulsations of the present invention may be performed to create effective perforation tunnels that enhance fluid communication between the formation and the wellbore. In the illustrated sequence, a first underbalance pulsation is indicated at 312, a second underbalance pulsation is indicated at 314 and a third underbalance pulsation is indicated at 316. Each of the underbalance pulsation 312, 314, 316 has its own underbalance signature. Specifically, underbalance pulsation 312 has a peak underbalance pressure that is less than the peak underbalance pressures of underbalance pulsations 314, 316 and underbalance pulsation 314 has a peak underbalance pressure that is less than the peak underbalance pressure of underbalance pulsation 316. Likewise, underbalance pulsation 312 has a duration that is greater than the durations of underbalance pulsations 314, 316 and underbalance pulsation 314 has duration that is greater than the duration of underbalance pulsation 316. In addition, the time period between underbalance pulsation 312 and underbalance pulsation 314 is greater than the time period between underbalance pulsation 314 and underbalance pulsation 316. Also, as illustrated, underbalance pulsation 314 does not begin until after underbalance pulsation 312 is complete and the wellbore pressure has substantially stabilized at reservoir pressure indicated at 318. Likewise, underbalance pulsation 316 does not begin until after underbalance pulsation 314 is complete and the wellbore pressure has substantially stabilized at reservoir pressure indicated at 320.

Figure 4:
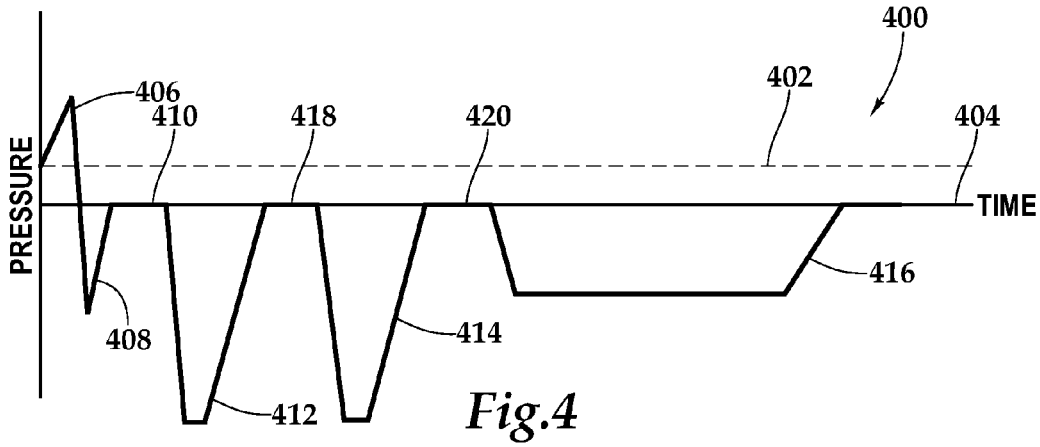
FIG. 4 is a pressure versus time diagram depicting the pressure response in a wellbore created during the performance of a method for optimizing wellbore perforations according to the present invention.

Referring next to FIG. 4, a pressure versus timing graph illustrating pressure changes in a perforating interval is generally designated 400. As illustrated, the wellbore has an initial static overbalance pressure condition depicted as dashed line 402, which is at a predetermined pressure above reservoir pressure, which is indicated at 404. Upon detonation of the shaped charges within the perforating gun or gun string, an initial dynamic overbalance condition is generated in the near wellbore region due to detonation gases, which is indicated at 406. The empty volume within the perforating guns and any associated blank pipe may then generate a dynamic underbalance condition in the near wellbore region, which is indicated at 408. After a short time, the wellbore pressure stabilizes at reservoir pressure as indicated at 410.

Thereafter, a customizable sequence of underbalance pulsations of the present invention may be performed to create effective perforation tunnels that enhance fluid communication between the formation and the wellbore. In the illustrated sequence, a first underbalance pulsation is indicated at 412, a second underbalance pulsation is indicated at 414 and a third underbalance pulsation is indicated at 416. Underbalance pulsation 412, 414 have substantially similar underbalance signatures while underbalance pulsation 416 has a different underbalance signature. Specifically, underbalance pulsations 412, 414 have substantially similar peaks underbalance pressures which are greater than the peak underbalance pressure of underbalance pulsations 416. Likewise, underbalance pulsations 412, 414 have substantially similar durations that are less than the duration of underbalance pulsation 416. In the illustrated sequence, the time period between underbalance pulsation 412 and underbalance pulsation 414 is less than the time period between underbalance pulsation 414 and underbalance pulsation 416. Also, as illustrated, underbalance pulsation 414 does not begin until after underbalance pulsation 412 is complete and the wellbore pressure has substantially stabilized at reservoir pressure indicated at 418. Likewise, underbalance pulsation 416 does not begin until after underbalance pulsation 414 is complete and the wellbore pressure has substantially stabilized at reservoir pressure indicated at 420.

Figure 5:
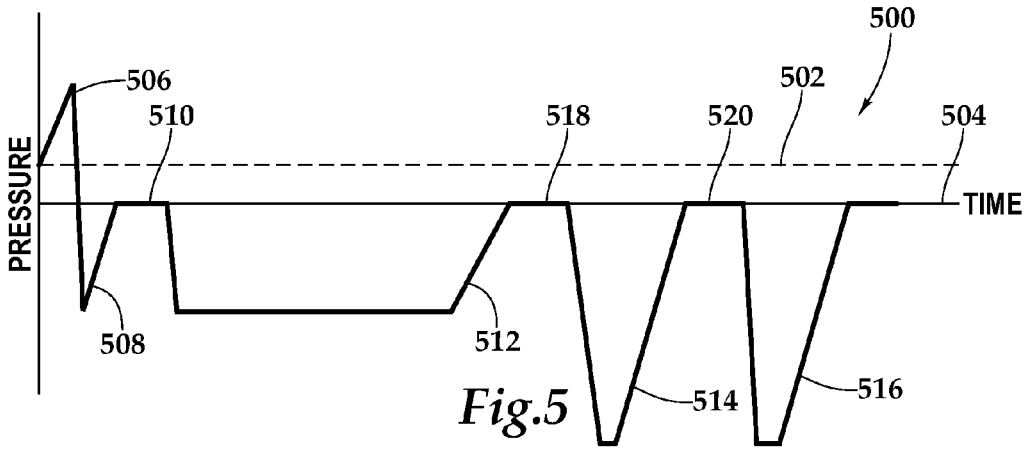
FIG. 5 is a pressure versus time diagram depicting the pressure response in a wellbore created during the performance of a method for optimizing wellbore perforations according to the present invention.

Referring next to FIG. 5, a pressure versus timing graph illustrating pressure changes in a perforating interval is generally designated 500. As illustrated, the wellbore has an initial static overbalance pressure condition depicted as dashed line 502, which is at a predetermined pressure above reservoir pressure, which is indicated at 504. Upon detonation of the shaped charges within the perforating gun or gun string, an initial dynamic overbalance condition is generated in the near wellbore region due to detonation gases, which is indicated at 506. The empty volume within the perforating guns and any associated blank pipe may then generate a dynamic underbalance condition in the near wellbore region, which is indicated at 508. After a short time, the wellbore pressure stabilizes at reservoir pressure as indicated at 510.

Thereafter, a customizable sequence of underbalance pulsations of the present invention may be performed to create effective perforation tunnels that enhance fluid communication between the formation and the wellbore. In the illustrated sequence, a first underbalance pulsation is indicated at 512, a second underbalance pulsation is indicated at 514 and a third underbalance pulsation is indicated at 516. Underbalance pulsation 514, 516 have substantially similar underbalance signatures while underbalance pulsation 512 has a different underbalance signature. Specifically, underbalance pulsations 514, 516 have substantially similar peaks underbalance pressures which are greater than the peak underbalance pressure of underbalance pulsations 512. Likewise, underbalance pulsations 514, 516 have substantially similar durations that are less than the duration of underbalance pulsation 512. In the illustrated sequence, the time period between underbalance pulsation 512 and underbalance pulsation 514 is substantially similar to the time period between underbalance pulsation 514 and underbalance pulsation 516. Also, as illustrated, underbalance pulsation 514 does not begin until after underbalance pulsation 512 is complete and the wellbore pressure has substantially stabilized at reservoir pressure indicated at 518. Likewise, underbalance pulsation 516 does not begin until after underbalance pulsation 514 is complete and the wellbore pressure has substantially stabilized at reservoir pressure indicated at 520.

Figure 6:
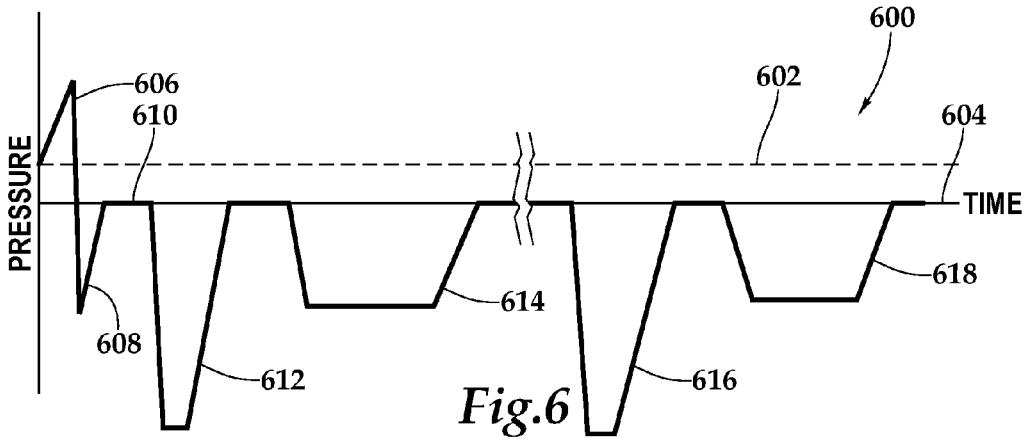
FIG. 6 is a pressure versus time diagram depicting the pressure response in a wellbore created during the performance of a method for optimizing wellbore perforations according to the present invention.

Referring next to FIG. 6, a pressure versus timing graph illustrating pressure changes in a perforating interval is generally designated 600. As illustrated, the wellbore has an initial static overbalance pressure condition depicted as dashed line 602, which is at a predetermined pressure above reservoir pressure, which is indicated at 604. Upon detonation of the shaped charges within the perforating gun or gun string, an initial dynamic overbalance condition is generated in the near wellbore region due to detonation gases, which is indicated at 606. The empty volume within the perforating guns and any associated blank pipe may then generate a dynamic underbalance condition in the near wellbore region, which is indicated at 608. After a short time, the wellbore pressure stabilizes at reservoir pressure as indicated at 610.

Thereafter, a customizable sequence of underbalance pulsations of the present invention may be performed to create effective perforation tunnels that enhance fluid communication between the formation and the wellbore. In the illustrated sequence, a plurality of underbalance pulsations are indicated at 612, 614, 616, 618. Underbalance pulsations 612, 616 have substantially the same peak underbalance pressures and durations. Underbalance pulsations 614, 618 have substantially the same peak underbalance pressures and durations which are different from those of underbalance pulsations 612, 616. Each subsequent underbalance pulsation begins after the prior underbalance pulsation has substantially stabilized at reservoir pressure. In the illustrated sequence, the time periods of underbalance pulsations 612, 614 and underbalance pulsations 616, 618 are indicated as being on a different time frame, for example, while the time period between underbalance pulsations 612, 614 may be on the order of milliseconds to second, the time period between underbalance pulsations 614, 616 may be on the order of minutes to hours or more.

Figure 7:
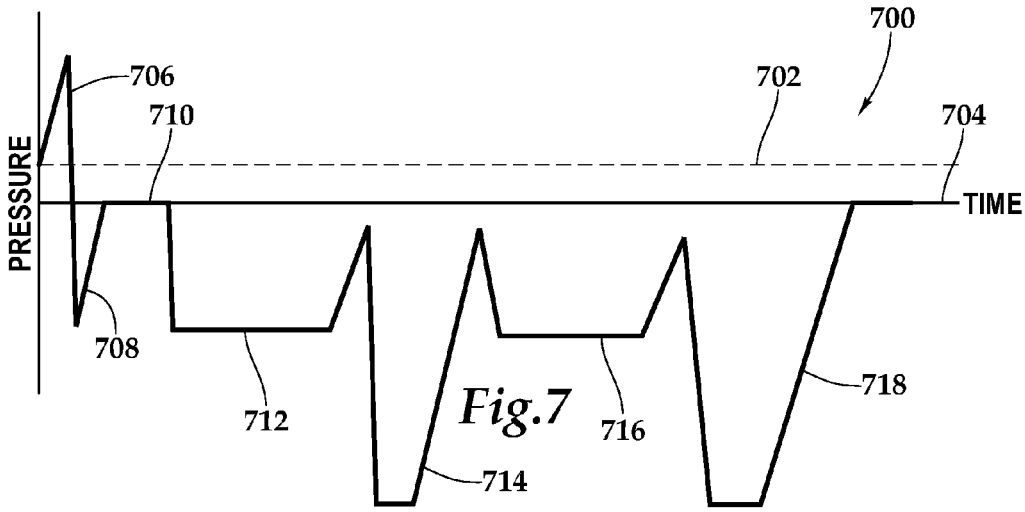
FIG. 7 is a pressure versus time diagram depicting the pressure response in a wellbore created during the performance of a method for optimizing wellbore perforations according to the present invention.

Referring next to FIG. 7, a pressure versus timing graph illustrating pressure changes in a perforating interval is generally designated 700. As illustrated, the wellbore has an initial static overbalance pressure condition depicted as dashed line 702, which is at a predetermined pressure above reservoir pressure, which is indicated at 704. Upon detonation of the shaped charges within the perforating gun or gun string, an initial dynamic overbalance condition is generated in the near wellbore region due to detonation gases, which is indicated at 706. The empty volume within the perforating guns and any associated blank pipe may then generate a dynamic underbalance condition in the near wellbore region, which is indicated at 708. After a short time, the wellbore pressure stabilizes at reservoir pressure as indicated at 710.

Thereafter, a customizable sequence of underbalance pulsations of the present invention may be performed to create effective perforation tunnels that enhance fluid communication between the formation and the wellbore. In the illustrated sequence, a plurality of underbalance pulsations are indicated at 712, 714, 716, 718. Underbalance pulsations 712, 716 have substantially the same peak underbalance pressures and durations. Underbalance pulsations 714, 718 have substantially the same peak underbalance pressures and durations which are different from those of underbalance pulsations 712, 716. In the illustrated sequence, each subsequent underbalance pulsation begins before the prior underbalance pulsation has stabilized at reservoir pressure.

Even though the illustrated examples depict either three or four underbalance pulsations, the present invention for optimizing perforations in a wellbore may including any number of underbalance pulsations both more than and less than those depicted without departing from the principles of the present invention. In addition, even though each underbalance pulsation has been described as being generated by a single pulsation chamber, the underbalance pulsations of the present invention could alternatively be generated by multiple pulsation chambers or other underbalance pulsation generation devices.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for optimizing perforations in a wellbore, the method comprising:

disposing a perforating string in the wellbore;

perforating the wellbore; and operating a plurality of pulsation chambers to perform a sequence of underbalance pulsations in the wellbore, wherein a first underbalance pulsation has a first underbalance signature and a second underbalance pulsation has a second underbalance signature that is different from the first underbalance signature, wherein the second underbalance pulsation is initiated during a time period when wellbore pressure has substantially stabilized at reservoir pressure following the first underbalance pulsation.

2. The method as recited in claim 1 wherein the second underbalance signature has a peak underbalance pressure that is greater than a peak underbalance pressure of the first underbalance signature.

3. The method as recited in claim 1 wherein the second underbalance signature has a peak underbalance pressure that is less than a peak underbalance pressure of the first underbalance signature.

4. The method as recited in claim 1 wherein the second underbalance signature has a duration that is greater than a duration of the first underbalance signature.

5. The method as recited in claim 1 wherein the second underbalance signature has a duration that is less than a duration of the first underbalance signature.

6. The method as recited in claim 1 wherein the second underbalance signature has a peak underbalance pressure that is greater than a peak underbalance pressure of the first underbalance signature and wherein the second underbalance signature has a duration that is less than a duration of the first underbalance signature.

7. The method as recited in claim 1 wherein the second underbalance signature has a peak underbalance pressure that is less than a peak underbalance pressure of the first underbalance signature and wherein the second underbalance signature has a duration that is greater than a duration of the first underbalance signature.

8. The method as recited in claim 1 wherein performing the sequence of underbalance pulsations in the wellbore further comprises performing first, second and third underbalance pulsations, wherein each of the first, second and third underbalance pulsations has a different underbalance signature.

9. The method as recited in claim 8 wherein the underbalance signatures of the first, second and third underbalance pulsations have progressively smaller peak underbalance pressures.

10. The method as recited in claim 8 wherein the underbalance signatures of the first, second and third underbalance pulsations have progressively larger durations.

11. The method as recited in claim 8 wherein a time period between the first and second underbalance pulsations is less than a time period between the second and third underbalance pulsations.

12. The method as recited in claim 8 wherein a time period between the first and second underbalance pulsations is greater than a time period between the second and third underbalance pulsations.

13. A method for optimizing perforations in a wellbore, the method comprising:

disposing a perforating string in the wellbore;

perforating the wellbore; and operating a plurality of pulsation chambers to perform a sequence of underbalance pulsations in the wellbore including a plurality of underbalance pulsations each having a different underbalance signature and wherein each subsequent underbalance pulsations is initiated during a time period when wellbore pressure has substantially stabilized at reservoir pressure following a prior underbalance pulsation.

14. The method as recited in claim 13 wherein a peak underbalance pressure of each of the underbalance pulsations becomes progressively smaller.

15. The method as recited in claim 13 wherein a duration of each of the underbalance pulsations becomes progressively larger.

16. The method as recited in claim 13 wherein a time period between each of the underbalance pulsations becomes progressively larger.

17. A method for optimizing perforations in a wellbore, the method comprising:

disposing a perforating string in the wellbore;

perforating the wellbore; and operating a plurality of pulsation chambers to perform a sequence of underbalance pulsations in the wellbore including at least three underbalance pulsations, wherein two of the at least three underbalance pulsations have substantially similar underbalance signatures and wherein one of the at least three underbalance pulsations has an underbalance signature that is different from the substantially similar underbalance signatures and wherein the each subsequent underbalance pulsations is initiated during a time period when wellbore pressure has substantially stabilized at reservoir pressure following a prior underbalance pulsation.

18. The method as recited in claim 17 wherein performing the sequence of underbalance pulsations in the wellbore further comprises performing the two underbalance pulsations having substantially similar underbalance signatures prior to performing the underbalance pulsation having the different underbalance signature.

19. The method as recited in claim 17 wherein performing the sequence of underbalance pulsations in the wellbore further comprises performing the two underbalance pulsations having substantially similar underbalance signatures after performing the underbalance pulsation having the different underbalance signature.

* * * * *